US005727517A

United States Patent [19]

Mallen

[11] Patent Number: 5,727,517

[45] Date of Patent: Mar. 17, 1998

[54] EQUIVALENCE-BOOSTED SLIDING VANE INTERNAL COMBUSTION ENGINE

[76] Inventor: Brian D. Mallen, 239 Colonnade Dr., #6, Charlottesville, Va. 22903

[21] Appl. No.: 605,836

[22] Filed: Apr. 22, 1996

Related U.S. Application Data

[63] Continuation-in-part of Ser. No. 594,284, Jan. 30, 1996, abandoned.

[51] Int. Cl.[6] ..... F02B 53/00

[52] U.S. Cl. ..... 123/217; 123/243

[58] Field of Search ..... 123/203, 217, 123/243, 568

[56] References Cited

U.S. PATENT DOCUMENTS

| | | | |
|---|---|---|---|
| 1,102,742 | 7/1914 | Hauer . | |
| 1,102,746 | 7/1914 | Hauer . | |
| 1,269,937 | 6/1918 | Hutsell . | |
| 1,492,456 | 4/1924 | Hansen-Ellehammer . | |
| 1,605,912 | 11/1926 | Barker . | |
| 1,735,477 | 11/1929 | Stuart . | |
| 1,758,320 | 5/1930 | Hoss . | |
| 1,914,091 | 6/1933 | Hamilton et al. . | |
| 2,374,445 | 4/1945 | McFarland . | |
| 2,435,476 | 2/1948 | Summers . | |
| 2,556,315 | 6/1951 | Adams et al. . | |
| 2,974,603 | 3/1961 | Fraser . | |
| 2,985,110 | 5/1961 | Burt et al. . | |
| 3,180,271 | 4/1965 | Hartmann . | |
| 3,221,665 | 12/1965 | Hartmann . | |
| 3,407,742 | 10/1968 | Mitchell et al. . | |
| 3,437,079 | 4/1969 | Odawara . | |
| 3,516,769 | 6/1970 | Korhonen . | |
| 3,548,790 | 12/1970 | Pitts . | |
| 3,809,020 | 5/1974 | Takitani . | |
| 3,819,309 | 6/1974 | Jacobs . | |
| 3,820,515 | 6/1974 | Knisch . | |
| 3,869,231 | 3/1975 | Adams . | |
| 3,886,910 | 6/1975 | Vrooman . | |
| 3,942,484 | 3/1976 | Pile . | |
| 3,964,447 | 6/1976 | Normandin . | |
| 4,004,556 | 1/1977 | Pfieffer . | |
| 4,075,981 | 2/1978 | Durst . | |
| 4,170,213 | 10/1979 | Williams . | |
| 4,230,088 | 10/1980 | Southard . | |
| 4,241,713 | 12/1980 | Crutchfield . | |
| 4,256,064 | 3/1981 | Thorn | 123/568 |
| 4,355,965 | 10/1982 | Lowther . | |
| 4,401,070 | 8/1983 | McCaan . | |
| 4,439,117 | 3/1984 | Bunger . | |
| 4,638,776 | 1/1987 | Crittenden . | |
| 4,840,164 | 6/1989 | Parsons | 123/568 |
| 5,277,158 | 1/1994 | Pangman . | |
| 5,415,141 | 5/1995 | McCann . | |
| 5,423,297 | 6/1995 | Roberts . | |
| 5,429,084 | 7/1995 | Cherry et al. . | |
| 5,433,179 | 7/1995 | Wittry . | |
| 5,479,887 | 1/1996 | Chen . | |

FOREIGN PATENT DOCUMENTS

| | | | |
|---|---|---|---|
| 2120373 | 11/1971 | Germany | 123/217 |

*Primary Examiner*—Michael Koczo
*Attorney, Agent, or Firm*—Jones & Volentine, L.L.P.

[57] ABSTRACT

A sliding vane internal combustion engine that provides one or more expansion gas ducts directing pressurized gases from expansion volumes of the vane engine into an intake charge so as to increase the intake charge density. One or more intercoolers may be coupled to the expansion gas ducts to cool the pressurized gases flowing into the intake region. One or more bypass passages may also be provided to direct the pressurized gas flow around the corresponding intercooler. One or more flow control valves may be provided to control the rate of the pressurized gas flow into the intake region.

10 Claims, 5 Drawing Sheets

EQUIVALENCE-BOOSTED SLIDING VANE INTERNAL COMBUSTION ENGINE

This is a Continuation-In-Part of application Ser. No. 08/594,284 (Attorney Docket No. MALLEN.007), filed on Jan. 30, 1996, now abandoned.

BACKGROUND OF THE INVENTION

1. Field of the Invention

The present invention generally relates to internal combustion engines, and more particularly, to an improved sliding vane internal combustion engine having expansion gas ducts for transferring pressurized expansion gases to the intake/compression region of the engine.

2. Description of the Related Art

While the mechanism of the piston engine dates back almost three centuries to the development of the steam engine, this piston-in-cylinder design continues to power nearly all ground transportation. However, emissions from piston internal combustion piston engines—consisting of nitrogen oxides, carbon monoxide, hydrocarbons, and soot—represent the largest constituent of urban atmospheric pollution worldwide. The roots of our modern engine technology came at a time when developers understood neither pollution chemistry nor fuel efficiency constraints. It should then come as no surprise that the internal combustion piston engine geometry is incompatible with the present-day dictates of ultra-low pollution output and high fuel efficiency.

Prior attempts to improve on the piston engine's performance have improved one parameter at the expense of others. For example, Rudolf Diesel conceived his design with the goal of improving on the efficiency of the piston engine. The efficiency improvements, however, came at the expense of higher pollution and weight. Felix Wankel conceived his engine with the goal of reducing weight compared with the piston engine. The weight reductions were achieved at the expense of higher pollution and lower efficiency.

Pending U.S. patent application Ser. No. 08/398,443 to Brian D. Mallen et al., filed Mar. 3, 1995, entitled "Sliding Vane Engine" (Attorney Docket No. MAL.003); Ser. No. 08/504,016 to Brian D. Mallen, filed Jul. 19, 1995, entitled "Method Of Reducing Emissions In A Sliding Vane Internal Combustion Engine" (Attorney Docket No. MAL.005); and Ser. No. 08/554,841, to Brian D. Mallen, filed Nov. 7, 1995, entitled "Five-Cycle Sliding Vane Internal Combustion Engine" (Attorney Docket No. MALLEN.006), have disclosed and described unique sliding vane internal combustion engine designs that improve on not one, but three important criteria concerning modern engine applications: pollution emissions, fuel efficiency, and power density. They are practical, mainstream engine designs conceived with the mandates of ultra-low pollution emissions embedded in their geometries.

Importantly, ultra-low pollution emissions are achieved by these unique designs for a variety of fuels, including standard gasoline, without the need for a catalytic converter. The existing fuel supply infrastructure, therefore, does not need to be changed to accommodate this technology. The elegant designs require no catalytic converter to achieve their emissions performance. The emissions strategy minimizes pollution caused by combustion, rather than attempting to reduce existing levels downstream in the exhaust system.

Further refinements to the vane engine design are described in the present disclosure, including a means to substantially boost the power to weight and power to size ratios with an integral design, without adding new moving parts or substantial complexity.

SUMMARY OF THE INVENTION

Accordingly, the present invention is directed to a sliding vane internal combustion engine which substantially overcomes one or more limitations of the prior art. The invention provides features which greatly enhance the performance of the sliding vane design.

To achieve these and other advantages and in accordance with the purpose of the invention, as embodied and broadly described, the invention is a sliding vane internal combustion engine, comprising a stator having a central cavity; a rotor disposed in the central cavity, the rotor having a plurality of radial slots and the rotor and stator being in relative rotation; a plurality of vanes, each of the plurality of vanes sliding within the respective radial slots of the rotor, the plurality of vanes, stator cavity, and rotor defining a plurality of chamber cells, the chamber cells creating cascading volumes of compression, combustion, expansion, exhaust and intake; and one or more expansion gas ducts directing pressurized gases from the expansion volumes into an intake region so as to increase the intake charge density.

In an alternate embodiment, one or more intercoolers may be coupled to the corresponding expansion gas ducts to cool the expansion gases flowing into the intake region. With either embodiment, each of the expansion ducts may communicate with a flow control valve to control the rate of the expansion gas flow into the intake region. Also, bypass passages may be provided to direct the expansion gas flow around the corresponding intercooler.

In another alternate embodiment, the invention provides for a method for reducing exhaust pollution emissions in a sliding vane internal combustion engine, the method comprising the steps of: (1) inducting a fuel-air combination into a vane cell; (2) injecting pressurized gases from an expansion region into the vane cell to achieve a diluent ratio less than about 0.6; (3) thoroughly mixing the fuel-air combination and the pressurized gases; (4) combusting the fuel-air combination and pressurized gas mixture; (5) ducting, prior to purging, a portion of the pressurized gases from the expansion region; and (6) purging the combusted fuel-air combination and pressurized gas mixture.

The invention thus provides a means to intercool the pressurized expansion/exhaust gases in order to increase the density of the charge, thereby optimizing the power density improvement and reducing thermal stresses.

The unique features of the present invention can be directed to various embodiments, such as for example, two-stroke and four-stroke sliding vane engines, and sliding vane engines wherein the vanes slide with an axial component of motion.

BRIEF DESCRIPTION OF THE DRAWINGS

The foregoing and other objects, aspects, and advantages will be better understood from the following detailed description of the embodiments of the invention with reference to the drawings, in which.

DETAILED DESCRIPTION OF THE INVENTION

The invention is directed to a sliding vane engine that provides several unique features—both individually and in combination—which enhance the performance of the sliding vane design.

The sliding vane engine designs, and methods of reducing emissions in sliding vane engines, disclosed in pending U.S. patent application Ser. No. 08/398,443 to Brian D. Mallen et al., entitled "Sliding Vane Engine", filed Mar. 3, 1995 (Attorney Docket No. MAL.003); U.S. patent application Ser. No. 08/504,016 to Brian D. Mallen, entitled "Method of Reducing Emissions in a Sliding Vane Engine", filed Jul. 19, 1995 (Attorney Docket No. MAL.005); and U.S. patent application Ser. No. 08/554,841, to Brian D. Mallen, filed Nov. 7, 1995, entitled "Five-Cycle Sliding Vane Internal Combustion Engine" (Attorney Docket No. MALLEN.006), are hereby incorporated by reference in their entirety. Portions of the pending applications are set forth where appropriate for ease of reference and discussion.

Reference will now be made in detail to one embodiment of a sliding vane engine, an example of which is illustrated in the accompanying drawings, in sufficient detail to appropriately describe the apparatus and method of the present invention. The dimensions of the drawings have been exaggerated and distorted to better illustrate the respective features.

In this embodiment, an engine geometry is employed utilizing sliding vanes which extend and retract synchronously with the rotation of the rotor and the shape of the chamber surface in such a way as to create regions of intake, compression, combustion, expansion, and exhaust thereby providing the essential components of a five-phase, four-stroke engine cycle.

Figure 1:
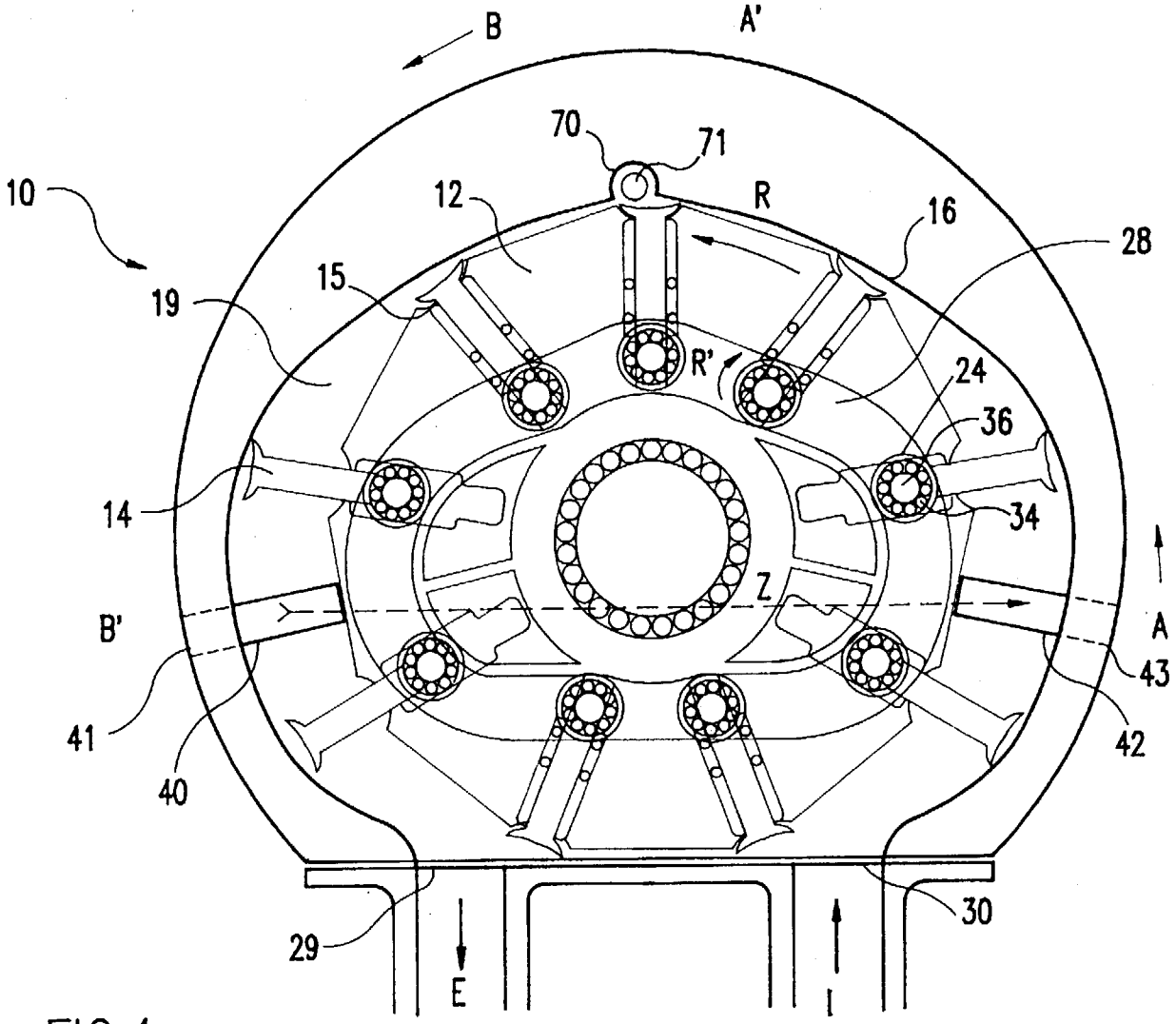
FIG. 1 is a side cross-sectional view of the sliding-vane engine illustrating expansion gas ducts in accordance with the present invention.

An exemplary embodiment of the sliding vane engine apparatus is shown in FIG. 1 and is designated generally as reference numeral 10. The structure of the engine 10 is described in detail in U.S. patent application Ser. No. 08/554,841, to Brian D. Mallen, filed Nov. 7, 1995, entitled "Five-Cycle Sliding Vane Internal Combustion Engine" (Attorney Docket No. MALLEN.006). The following summary is thus provided for ease of reference and to facilitate the description of the current invention.

The engine 10 contains a rotor 12, rotating in a counterclockwise direction as shown by arrow R in FIG. 1. The rotor 12 houses a plurality of vanes 14 which slide in a radial direction within the respective plurality of vane slots 15, the adjacent vanes 14 defining a plurality of vane cells 19. A stator 16 forms the roughly triangular-elliptical shape of the chamber outer surface. It is understood that the sliding vane engine would also operate where the rotor 12 rotates in a clockwise direction, or if the 'rotor' were fixed and the 'stator' were rotating, or an arrangement in which both the 'stator' and 'rotor' were rotating in opposite directions, or an arrangement in which the 'stator' and 'rotor' were both rotating in the same direction but at different angular speeds. The arrangement could also be inverted so that the 'rotor' housing the sliding vanes surrounds a cam-shaped 'stator', one being in relative rotation to the other.

The illustrated embodiment employs a four-stroke sequence. This permits simple and efficient power throttling, reduces starter-motor power requirements, and maximizes cell volume while minimizing the cell sealing-gap surface area. Such an arrangement is suited for mainstream power usages. A two-stroke design will also permit the effective incorporation of the present invention.

The roller cam-followers 24 surround the vane pins 36 which ride in cam track 28. The cam-follower 24 and vane pin 36 may be separated by bearings 34 to reduce friction. In the illustrated embodiment, rotation of the roller cam-followers 24 is opposite to that of the rotor and designated by R' in FIG. 1. It should be understood that the engine could function adequately with alternative vane guiding means, such as the cam-follower bearings taking the form of non-rolling, fixed pins.

Intake and exhaust may occur through fixed openings in the staler body, see for example exhaust port 29 and intake port 30 in FIG. 1, or through fixed openings in the side plates. No moving valve mechanisms are required. The intake flow direction is designated by arrow I and the exhaust flow direction by arrow E. It is understood that the ports may be of various shapes, proportions, angles, curvatures, and sizes so as to best optimize the flow and manufacturing for a given application, as those skilled in the art of manifold design, fluid-mechanics, and manufacturing could determine.

Combustion may be assisted by a combustion residence cavity 70. A heating element 71, such as a cylindrical cartridge heater, could be installed in the cavity 70 as illustrated in FIG. 1. Such an arrangement would provide reliable combustion for both start-up and normal operation. The cylindrical cartridge heater 71 could be electrically heated and regulated.

With rotor rotation R as shown in FIG. 1, compression commences at approximately region A, taken at the mid-point of the vane cell, continuing to a point approximately at A'. The expansion region commences at approximately region B. As described thusfar, the pressure of the expanded gases at region B', taken before the vane cells 19 communicate with the exhaust port 29, will be greater than the pressure of the intake charge at region A, for any given intake charge pressure. Some degree of cycle overexpansion or under-expansion may be provided by altering the stator shape or by changing the relative durations of compression and expansion. Unless an Atkinson cycle is employed whereby the expanded gases are at the same pressure as the intake gases, there will exist a pressure differential between the two regions within the same cycle.

It is this pressure differential which the present invention uses to effectively boost the equivalence ratio and charge density and thereby the power density of the engine.

The pressurized expansion gases at region B' are ducted to the intake region A along a path illustrated as dashed line Z in FIG. 1. The pressurized expansion gases are tapped before or close to the point where the cell looses its pressure differential when the expansion gases open to exhaust port 29.

Figure 2:
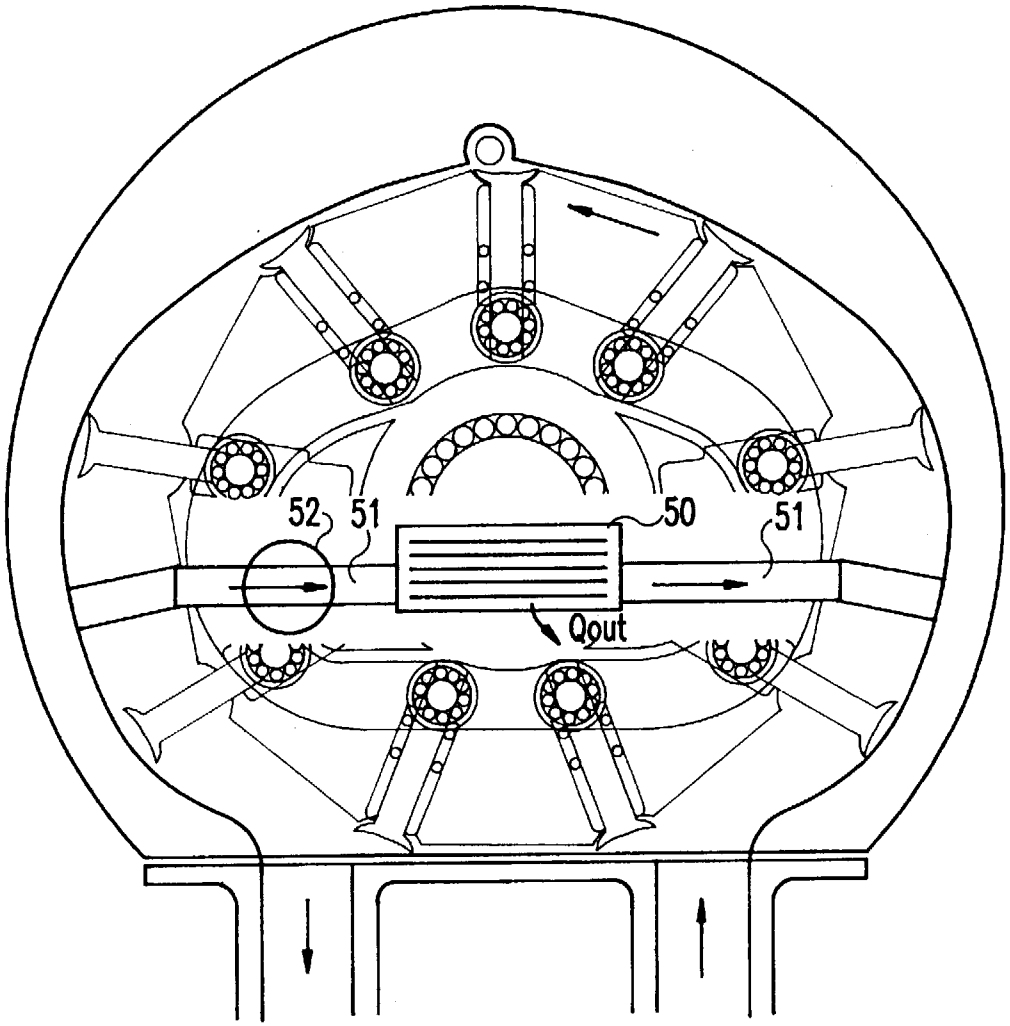
FIG. 2 is a partially-hidden side cross-sectional view of the sliding-vane engine in FIG. 1 illustrating the external intercooler and control valve in accordance with the present invention.

The dashed line Z actually represents the gas flow outside or external to the rotor/stator portion of the engine through external passage 51, as is more clearly shown in the partially-hidden side cross-sectional view of FIG. 2. In this way, expansion gases are ducted out of one side of the engine and into the other.

This is accomplished by using expansion gas ducts as shown in FIG. 1. The expansion gas ducts 40 and 42 may be located in either the side plates or the stator (represented by the dashed lines 41 and 43) or both, both of which are fixed components. One or more ducts may be located on one or both axial ends of the engine, or numerous ducts may be provided along the stator body.

Various sizes and shapes of the expansion gas ducts are contemplated within the practice of this invention. The exact dimensions might depend on a number of factors, including, but not limited to, expansion gas pressure and density, flow rate, engine speed and size, intake density, ambient intake density, and/or desired final intake region pressure.

The expansion gas ducts 40 and 42 (or 41 and 43) could communicate with an expansion region upstream of B' or a compression region downstream of A, as so defined by the flow direction of the rotor rotation R in FIG. 1. Such arrangements might facilitate the realization of higher pressures in the expansion duct or compression region, though in most cases such arrangements would not be preferable.

The above identified sliding vane patent applications of Mallen or Mallen et al. describe a sliding vane engine which operates at either an ultra-lean diluent ratio or an ultra-lean fuel-air ratio of less than about 0.60, in order to achieve ultra-low pollution emissions performance and enhance efficiency. In the case that the constituents mixed during the premixing step contain significant exhaust gases or gases other than fresh air which are not included as the combustible fuel, then it is the diluent ratio (DR) and not the equivalence ratio which describes the $NO_x$-pollution-effecting degree of diluent in the mixture. The diluent ratio DR is expressed as, $$DR=AFR_{stm}/GFR_m$$

where $GFR_m$ is the total non-combustible gas (G) to total fuel (F) ratio of the mixture. The stoichiometric air to fuel ratio is $AFR_{stm}$. Combustible gases, such as hydrogen or methane for example, are considered to be part of the fuel (F) portion, not the gas (G) portion of the mixture.

An equivalence ratio (E) is used to quantify the air-to-fuel ratio in the mixture ($AFR_m$) compared to the stoichiometric air-to-fuel ratio ($AFR_{stm}$) where:

$$E=AFR_{stm}/AFR_m$$

The air-to-fuel ratios used here refer to atmospheric air as the air portion and do not include exhaust gases.

By providing a means to pump pressurized expansion/exhaust gases back into the intake/compression region, with the optional addition of an intercooler (described later in the specification), the present invention can substantially boost the intake charge density and thus the power to weight and power to size ratios (power densities). Because the engine cycle operates at a lean fuel-air ratio before the pumping, sufficient oxygen remains in the exhaust to substantially enrich the fuel-air equivalence ratio while maintaining an ultra-lean diluent ratio. In other words, the present invention allows the engine to integrally boost the fuel-air equivalence ratio while maintaining an ultra-lean diluent ratio necessary for ultra-low emissions and high-efficiency performance, hence the term "equivalence-boosted".

For example, if the engine were initially operating at a fuel-air equivalence ratio of 0.50, then the equivalence-boosting would theoretically permit the engine to almost double its power density thereby achieving a stoichiometric equivalence ratio of close to 1 while maintaining an ultra-lean diluent ratio.

The equivalence ratio must be properly controlled via a mixture-regulating device such as fuel injection or carburetion, as the intake charge density is increased and the exhaust gas concentration of the intake charge changes. The goal of such regulation is to provide an equivalence ratio as close to stoichiometric (maximum power) as possible while maintaining an ultra-lean diluent ratio consistent with low pollution emissions.

One example illustrating a means of performing this mixture-regulation consists of a computer-controlled fuel injection system with a sensor providing information on oxygen concentration in the expansion duct or exhaust manifold combined with a pressure sensor providing information on the intake charge pressure. A temperature sensor providing information on the intake charge temperature might be useful in most accurately determining intake charge density. The computer could compute the proper concentration of fuel to inject for the combination of throttle setting, ambient density, and equivalence boost. Other configurations are possible.

As shown in FIG. 1, the expansion gas duct openings 40 and 42 are located in the side plates and are approximately the same shape and cross-sectional size as the vanes, thereby preventing flow from substantially communicating around the vane or the duct as it passes by the openings. The stator side plates house the rotor shaft within a bearing and attach to the stator at either axial end of the rotor, thereby sealing the vane cells in the axial directions.

Figure 4:
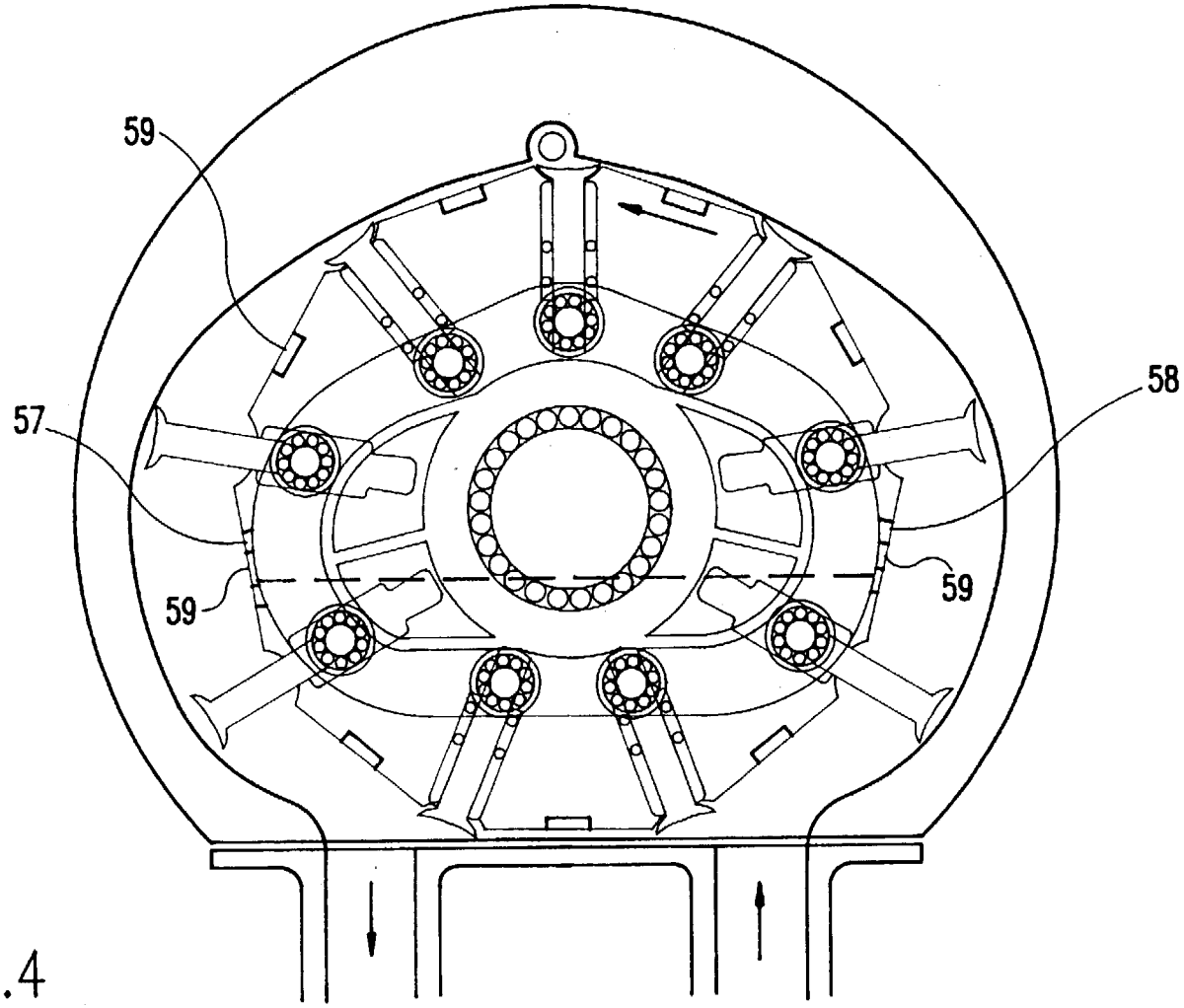
FIG. 4 is a side cross-sectional view of an alternate embodiment of the arrangement of the expansion gas ducts in accordance with the present invention.

In the alternate embodiment shown in FIG. 4, if duct openings 57 and 58 are provided in the side plates at a radial location closer to the center of rotation of the rotor than the circumference of the rotor, then small recesses 59 could be provided on one or both rotor ends to communicate with these retracted side plate ports to reduce or control the duration of opening to the equivalence-boost flow. While such an arrangement adds some complexity, it may reduce the number of required vanes or permit greater flexibility in chamber shape design.

A combination of the proper chamber shape, sufficient numbers of vanes, and the proper equivalence-boost-port shapes must be employed so as to ensure the above separation between expansion, equivalence-boost porting, and exhaust on one side; and separation between intake, equivalence-boost porting, and compression on the other side. In other words the complete cycle is segmented into intake, expansion-duct induction, compression, combustion, expansion, expansion-duct expulsion, and exhaust.

The illustrated embodiment basically employs one such permissible arrangement, although countless permutations are possible. Some degree of overlap may be permitted because of the time required for the air masses to move between locations. Also, the expansion gas ducts 40 and 42 (or 41 and 43) may be closed by a vane on the intake side while open on the exhaust side, or vice versa, thereby shutting-off the cross-flow for a small duration. This last effect may advantageously used to mitigate the overlap constraints somewhat.

The ducted expansion gases may be cooled by an intercooler 50 located external to the engine 10 as shown in the partially-hidden cross section view of FIG. 2. This cooling device may be of any design known to those skilled in the art of heat exchanger design. The purpose is to remove heat from the hot expanded gases, thereby producing a more dense and cooler charge to pump into the intake region. It is the pressure of the remaining exhaust gases in the expansion cell which drives the charge into the intake region, thereby increasing the charge density and permitting a richer fuel-air ratio to be employed. The heat $Q_{out}$ taken from the intercooler 50 could be ducted to the environment or used for various other functions such as heating the interior of a car or plane.

Additional intake and/or compression cooling could be provided via cooling means such as cooling fins mounted on the outer stator and/or side plates at a region corresponding to the compression region of the cycle. Such cooling means would permit higher compression ratios to be achieved without encountering preignition and would serve to reduce thermal stresses within any given configuration. As each vane cell sped past this region with the cooling means, the convective heat transfer of the air with the stationary cooled surfaces would cool the cell's contents.

Note that at least one flow control valve 52 in FIG. 2 may optionally be employed, with or without the intercooler 50, and at any point in the flow between the expansion and intake regions. The valve would permit the equivalence-boost to be 'throttled' in effect from 100% to 0%. The engine may run well without the valve, however, with a conventional throttle on the intake. Restriction devices could also be employed to choke the flow at a maximum boost level.

Figure 3:
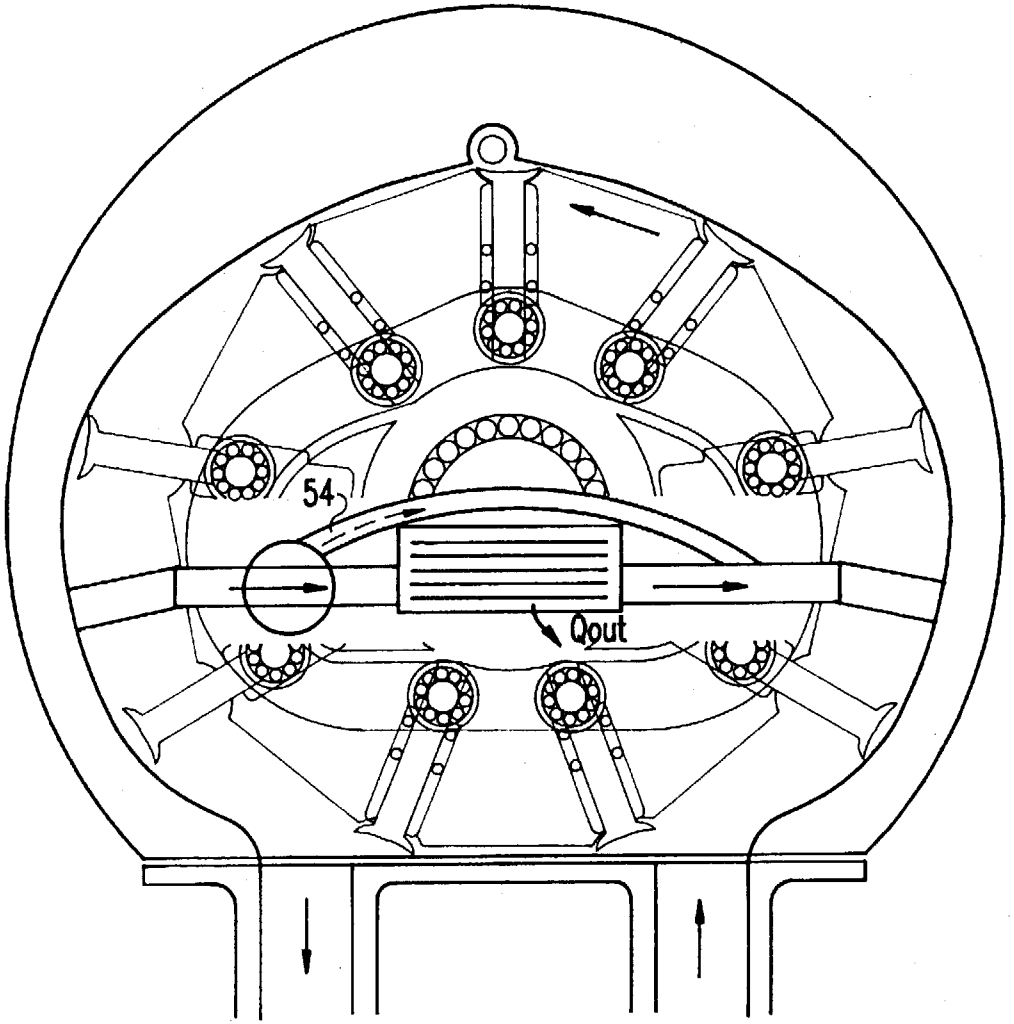
FIG. 3 is a partially-hidden side cross-sectional view of the sliding-vane engine in FIG. 1 illustrating the external intercooler bypass valve and passage in accordance with the present invention.

Referring to FIG. 3, at least one bypass passage 54 could also be employed, communicating before and after the intercooler 50 to direct part or all of the flow around the intercooler 50. Such an arrangement may be beneficial at start-up where rapid heatup of the engine may be desirable. This bypass passage 54 could also be used in conjunction with the control value 52. The expansion duct's flow could also be directed partially or in entirety, to other locations, with or without a control valve, and with or without the intercooler, such as a turbine, heat exchanger or heater, or the ambient intake of the engine.

In operation, the premixed intake air I may be thoroughly mixed at the proper concentration before the equivalence-boost flow communicates with the fuel-air charge and thereby dilutes the charge to an ultra-lean diluent ratio. The impulse of the equivalence-boost flow may be used to enhance the mixing of the fuel-air charge with the equivalence-boost flow. Mixing jets of various design as known to those skilled in the art of mixing may be used to effectively stir the two air masses with great rapidity during the intake process with the acquired motion continuing to stir the mixture into the compression process, thereby insuring optimum ultra-low emissions performance in accordance with the method described in U.S. patent application Ser. No. 08/504,016 to Brian D. Mallen, entitled "Method of Reducing Emissions in a Sliding Vane Engine", filed Jul. 19, 1995 (Attorney Docket No. MAL.005).

If the engine did not operate leaner than stoichiometric before equivalence boosting, then the equivalence boosting would not improve the power density, but would serve only as pressurized exhaust gas recirculation. Such forced recirculation could lower certain pollution levels. Thus, equivalence-boosting to a greater density after a stoichiometric air-fuel ratio has been reached, or simply pumping pressurized exhaust gases into the intake without increasing the air-fuel ratio, are both potentially desirable alternative uses contemplated within the practice of the present invention.

If more than one sliding vane engine is used on an assembly or pack of engines, whether or not thay share the same rotor shaft, then expansion and intake equivalence-boost ports may communicate between different engines to reduce duct length or complexity.

The present equivalence-boosting device is uniquely suited for operation with a vane engine, because the expansion gas ducts allow the designer to tap into any isolated part of the cycle with almost no additional complexity. In this case, the expansion gas duct 40 is positioned to duct pressurized expansion gases, that is, gases in a vane cell prior to opening up to the exhaust duct 29, for flow to the induction region after the ambient intake process has concluded.

The equivalence-boosting device described herein is substantially different from conventional exhaust gas recirculation and also charge boosting devices such as turbochargers or superchargers. In contrast to exhaust gas recirculation, the present invention utilizes pressurized, pre-exhaust expanded gases to directly pressurize the post-intake charge to a higher density, and it does so with almost no additional complexity.

Conventional exhaust gas recirculation simply directs exhaust gases or blowby gases to the intake region, without increasing the charge density or the power density of the engine. Thus, such devices do not increase the power output of the engine, but in fact, usually have the opposite effect of reducing power output because of the reduction in available oxygen volume.

Furthermore, in contrast to conventional charge boosting devices, the present invention does not employ additional moving elements. The power density of the present invention is dramatically increased with a minimal of additional complexity, and without additional moving elements and the need for lubrication of such elements.

Thus, the present invention offers substantial advantages over conventional devices. Using a single, simple duct to potentially double the power density of an engine is a dramatic boost for sliding vane engine performance. Furthermore, by substantially improving the power density of the sliding vane engine, the cost for a given power output or application will be reduced significantly, almost in proportion to the weight savings given the minimal complexity of the present invention.

Conventional turbocharging or Comprex wave-supercharging devices powered from the exhaust manifold may still be added in conjunction with the equivalence-boosting device to the exhaust of the sliding vane engine, to further increase charge density by feeding pressurized air to the intake manifold. Of course, such devices would also operate on a sliding vane engine without an equivalence-boosting device, though the net effect may be reduced. At least one turbine of a turbocharger could also be installed between the expansion and intake ports of the equivalence-boost duct. Such a turbine might provide further power to a compression device or generator, though it may also interfere with the optimum operation of the equivalence-boosting device. Conventional supercharging compressors could also be added to a sliding-vane engine with or without the present invention.

Figure 5:
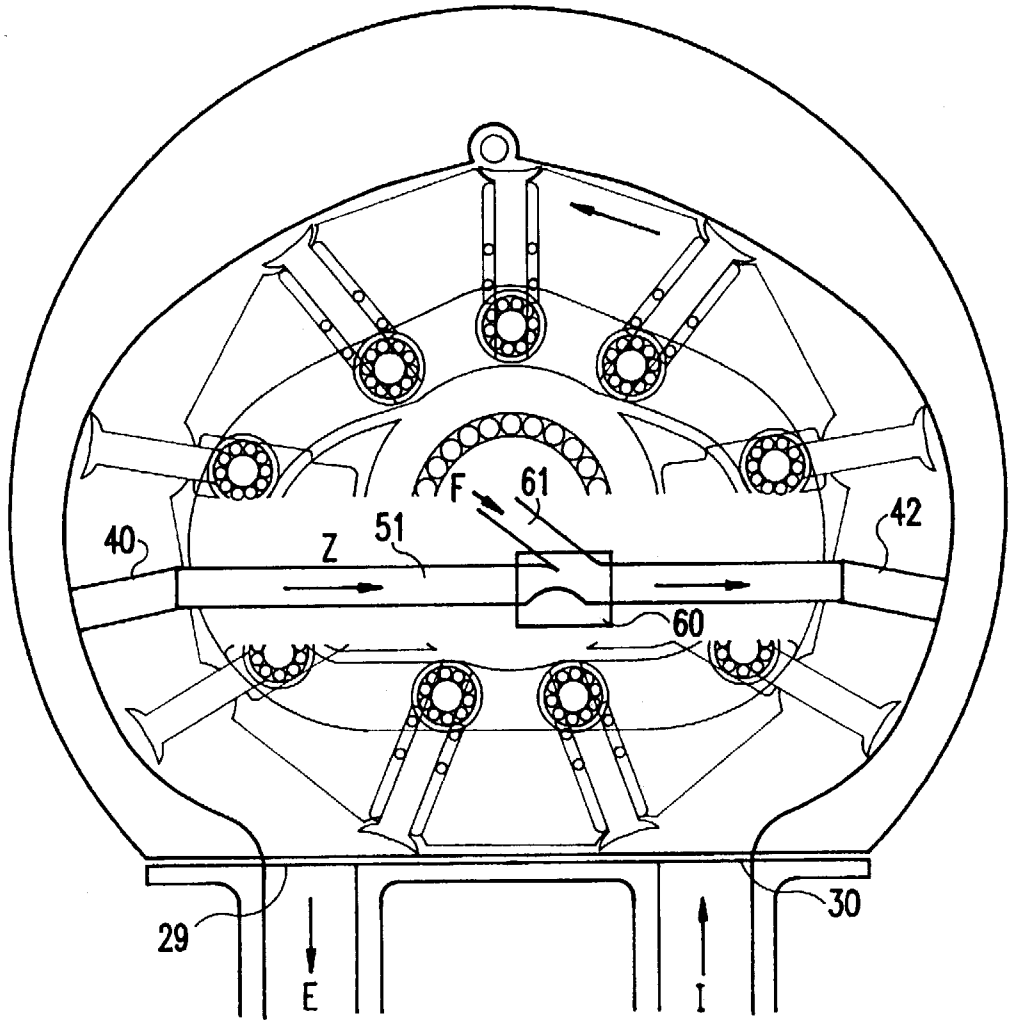
FIG. 5 is a partially-hidden side cross-sectional view of the sliding vane engine of FIG. 1 illustrating the jet pump of the present invention.

A means may be employed within the present invention to further boost the power density of the engine beyond that obtainable with the basic equivalence-boosted arrangement. With this means a jet-ejector pump 60 is employed within the external passage 51, which draws in a portion of fresh air F through fresh air duct 61 and combines it with the expansion charge from expansion gas duct 40. Note that jet pump 60 and FIG. 5 are distorted and simplified so as to simplify the presentation of the jet-pump device.

The fresh air F will be drawn-in and pressurized by the thrust of the high-pressure, high-speed expansion gas flow in the external passage 51. Conventional jet-pump configurations, as are well-know within the art of jet-pump design, may be employed with this means. In this way, additional oxygen may be added to the expansion gases to further boost the power density potential.

Fuel may be added to and also mixed with the fresh air F upstream and/or downstream of the jet-pump 60. The area ratio of the jet orifice will largely determine the degree of boost and the percent of dilution obtained, as is well-known in the art of jet-pump design.

As with the basic configuration discussed previously, an intercooler 50 may be employed with this embodiment as well, and the intercooler 50 may be located upstream or downstream of the fresh air induction. One or more optional valves may be employed to regulate the degree of fresh air induction and/or to control the orifice size and thus jet-pump performance.

It will be apparent to those skilled in the art that various modifications and variations can be made in the system and method of the present invention without departing from the spirit or scope of the invention. Thus, it is intended that the present invention cover the modifications and variations of this invention provided they come within the scope of the appended claims and their equivalents.

Having thus described my invention, what I claim as new and desire to secure by Letters Patent is as follows:

1. A sliding vane internal combustion engine, comprising:

a stator having a central cavity;

a rotor disposed in said central cavity, said rotor having a plurality of radial slots and said rotor and stator being in relative rotation;

a plurality of vanes, each of said plurality of vanes sliding within the respective radial slots of said rotor, said plurality of vanes, said stator cavity, and said rotor defining a plurality of chamber cells, said chamber cells creating cascading regions of compression, combustion, expansion, exhaust and intake; and one or more expansion gas ducts connecting said expansion region and said intake region to direct pressurized gases from said expansion region into said intake region so as to increase an intake charge density.

2. A sliding vane engine as in claim 1, further comprising one or more intercoolers coupled to said expansion gas ducts to cool the pressurized gases flowing into the intake region.

3. A sliding vane engine as in claim 2, further comprising one or more bypass passages to direct the pressurized gas flow around the intercooler.

4. A sliding vane engine as in claim 1, further comprising one or more flow control valves communicating with said expansion gas ducts to control the rate of the pressurized gas flow into the intake region.

5. A sliding vane engine as in claim 3, wherein said expansion gas ducts are located in side plates affixed to said stator.

6. A sliding vane engine as in claim 1, wherein said expansion gas ducts are located in said stator.

7. A sliding vane engine as in claim 1, wherein said expansion gas ducts are located in said stator and side plates affixed to said stator.

8. A sliding vane engine as in claim 1, further comprising a jet-pump connected to said expansion gas ducts and a fresh-air duct to draw in additional fresh-air into said intake region so as to further increase said intake charge density.

9. A method for reducing exhaust pollution emissions in a sliding vane internal combustion engine, said engine having a rotor disposed in a central cavity of a stator and a plurality of vanes sliding within respective slots in the rotor to create intake, compression, combustion, expansion and exhaust regions, the method comprising the steps of:

inducting a fuel-air combination into the intake region;

injecting pressurized gases from the expansion region into the intake region to achieve a diluent ratio less than about 0.6;

thoroughly mixing the fuel-air combination and the pressurized gases;

combusting said mixed fuel-air-pressurized gas combination;

ducting, prior to exhausting, a portion of said combusted fuel-air-pressurized gas from the expansion region to the intake region; and exhausting remaining of said combusted fuel-air-pressurized gas combination.

10. A sliding vane internal combustion engine, comprising:

a stator having a central cavity;

a rotor disposed in said central cavity, said rotor having a plurality of radial slots and said rotor and stator being in relative rotation;

a plurality of vanes, each of said plurality of vanes sliding within the respective radial slots of said rotor, said plurality of vanes, said stator cavity, and said rotor defining a plurality of chamber cells, said chamber cells creating cascading regions of compression, combustion, expansion, exhaust and intake; and one or more expansion gas ducts connecting said expansion region and said compression region to direct pressurized gases from said expansion region into said compression region so as to increase a charge density in said compression region.

* * * * *